US006285014B1

(12) United States Patent
Beck et al.

(10) Patent No.: US 6,285,014 B1
(45) Date of Patent: Sep. 4, 2001

(54) DOWNHOLE INDUCTION HEATING TOOL FOR ENHANCED OIL RECOVERY

(75) Inventors: Thomas Beck, Union Grove, WI (US); Stephen J. Garnall, Calgary (CA); David Seemab Kahn, Houston, TX (US); Bruce C. W. McGee, Calgary (CA); Alan J. Sallwasser, Houston, TX (US); George T. Stapleton, II, Sugar Land, TX (US); Mark W. Wassell, Kingwood, TX (US)

(73) Assignee: Neo PPG International, Ltd., Houston, TX (US)

( * ) Notice: Subject to any disclaimer, the term of this patent is extended or adjusted under 35 U.S.C. 154(b) by 0 days.

(21) Appl. No.: 09/561,362

(22) Filed: Apr. 28, 2000

(51) Int. Cl.[7] ..... H05B 6/10; H05B 6/38; E21B 43/24

(52) U.S. Cl. ..... 219/644; 219/670; 219/672; 219/676; 166/60; 166/248

(58) Field of Search ..... 219/643, 644, 219/635, 670, 672, 674, 676; 166/248, 60, 66.1, 66.5

(56) References Cited

U.S. PATENT DOCUMENTS

| | | | | |
|---|---|---|---|---|
| 3,119,917 | * | 1/1964 | Dehn | 219/644 |
| 3,570,594 | * | 3/1971 | Hamilton | 166/66 |
| 4,532,396 | * | 7/1985 | Burack et al. | 219/644 |
| 4,590,347 | * | 5/1986 | Thatcher et al. | 219/644 |
| 5,523,546 | * | 6/1996 | Lake | 219/644 |

FOREIGN PATENT DOCUMENTS

| | | |
|---|---|---|
| 2090629 | 9/1994 | (CA) . |
| 2208197 | 12/1998 | (CA) . |
| 0 848 577 * | 6/1998 | (EP) . |

* cited by examiner

*Primary Examiner*—Philip H. Leung
(74) *Attorney, Agent, or Firm*—Browning Bushman

(57) ABSTRACT

The tool comprises one or more core-coil assemblies 2 jacketed in an non-magnetic and electrically insulating, tubular outer housing, 10. The housing enables high power transfer efficiency. A structural skeleton 20 extends longitudinally through the tool for axially reinforcement. The core-coil assemblies 2 are encapsulated in epoxy 77 to mechanically rigidify and protect them as well as to isolate the coil windings 51 from the power bus 23 extending longitudinally of the core-coil assemblies through a peripheral busway 60, 61.

27 Claims, 10 Drawing Sheets

DOWNHOLE INDUCTION HEATING TOOL FOR ENHANCED OIL RECOVERY

Field of the Invention

The present invention relates to a heating system useful in the production of oil from a subterranean reservoir. More particularly it relates to a downhole induction-heating tool that can be placed in a wellbore and has the capability to electro-magnetically generate heat in the wellbore casing. In addition the invention relates to a method of heating a segment of wellbore casing electro-magnetically.

BACKGROUND OF THE INVENTION

It is common knowledge in the oil industry that the introduction of heat into an oil reservoir, especially a reservoir containing heavy or waxy oil, is beneficial. There are several methods used to achieve reservoir heating. They include steam injection, in situ combustion and electrical heating. The present invention is concerned with electrical heating.

Electric heating can take the form of resistance heating or induction heating. The present invention is concerned with induction heating. A significant drawback of the non-conductive heating approach is that high non-conductive heating element temperatures can cause coking, scaling and other forms of deposition, which raise the thermal resistance through which heat flows from the non-conductive element to the well bore. This elevated thermal resistance either increases the operating temperature of the non-conductive element for the same power level, or reduces the operational power level for the same element temperature.

Electric heating may also be classified by the method of conveying electric power to the downhole heater. In both non-conductive and inductive heating, electric power may be conveyed downhole via an isolated production tubing string. The present invention is concerned with inductive heating, in which electrical power is conveyed downhole via a cable running from the surface power system to the downhole tool.

Induction heating tools may be run into the wellbore of an existing well on a tubing string. The induction-heating tool may be landed opposite an interval to be heated. The tool can readily be removed for repair. There is no need for a permanent modification to the well to facilitate heating, such as the incorporation of isolators into the casing string, which is the case for some electrical heating systems which use the tubing string as an electrical conductor.

The tool itself comprises a transformer-type core-coil assembly jacketed in a tubular housing. Each core-coil assembly comprises a conductive wire coil wound on a magnetically permeable, laminated core. AC power is supplied to the coil from a power source at ground surface through a bus extending down the wellbore. Application of power to the coil induces eddy currents in the adjacent steel casing or screen liner, thereby increasing its temperature. The hot casing or liner in turn heats the near-wellbore region of the reservoir and oil within the wellbore. The term "casing" as used herein broadly means casing, sand exclusion liners and similar metal tubular goods having an interior flow path that defines the well bore.

Canadian Patent Application No. 2,208,197, filed by R. E. Isted and published Dec. 18, 1998, discloses an induction-heating tool. Although the application discloses a stainless steel, magnetically-transparent housing, the housing is not electro-magnetically transparent and a high tool winding operating temperature can be expected to reduce the tool operating life.

Canadian Patent 2,090,629, issued to J. E. Bridges on Dec. 29, 1998 discloses another induction heating tool. The '629 patent discloses a method of conveying electrical power via the production tubing. This method requires modification of the well casing for the installation of an electrically non-conductive window. This well modification is expensive and likely to be the source of serious reliability concerns.

The visco-skin effect, which reduces oil recovery, arises when heavy oil, approaching the wellbore, loses light ends due to changing pressure conditions, leaving a heavier oil clogging the reservoir immediately adjacent the wellbore. As previously stated, the hot casing heats both the near-wellbore region of the adjacent reservoir and the oil entering or within the casing. This has the benefits of ameliorating the visco-skin effect and improving the production and pumpability of the oil. The application of heat in this manner thus can stimulate and significantly improve the production rates of high viscosity heavy oil and waxy wells.

SUMMARY OF THE INVENTION

The present invention addresses many of the challenges that face one designing a downhole induction-heating tool. These challenges include:

(a) Maximizing the power dissipation within the casing while minimizing power dissipation within the tool. By minimizing tool power dissipation, tool operating temperature can be kept low, thus protecting tool components and raising limits on tool input power, without raising coil temperature;

(b) Providing a tool having desirable structural strength in longitudinal tension and compression and some flexibility, so that the tool can be pushed and pulled as it moves through the wellbore and can be worked past curves and other deviations of the wellbore;

(c) Providing a lengthy tool having a series of core-coil assemblies aligned longitudinally and arranged in contiguous or spaced apart configurations;

(d) Providing a tool adapted to facilitate the sharing of supplied power so that a single string of tubing can incorporate several tools to supply heat across a long production interval;

(e) Providing a tool having several core-coil assemblies, to smooth out the temperature profile extending along the casing;

(f) Achieving a design that is generic, so that a single tool design can be used in vertical, deviated and horizontal wells.

The work underlying the present invention has demonstrated the desirability of several features described below, which can be incorporated into a downhole induction-heating tool, either singly or in various combinations.

One feature of the tool is the use of a non-magnetic, electrically insulating, housing to enable high power transfer efficiency to the casing. Prior art technology has taught that a magnetically transparent housing, such as stainless steel, is sufficient to achieve satisfactory power transfer efficiency. A stainless steel housing, of sufficient thickness, could also provide desired structural strength, which would allow the tool to be pushed and pulled through the well bore. However, our work has shown that if a stainless steel housing is used, the heating process is limited by losses and heat builds up in the core-coil assembly to such an extent that it may become damaged.

A relatively thin fibreglass housing is non-magnetic and electrically insulating, but has low axial structural strength in compression and tension. In another feature of the invention, a longitudinally rigid reinforcing member, such as one or more steel rods, extends internally and longitudinally through each core-coil assembly. Spacers or joints providing high flexibility join the reinforcing members of individual adjacent core-coil assemblies. The tool thus has an internal "skeleton" which is strong longitudinally in tension and compression yet capable of flexing sufficiently to allow the tool to manoeuvre around bends in the wellbore. The non-magnetic, electrically insulating, housing is not relied upon for any axial structural strength.

In another feature, epoxy is used to encapsulate each core-coil assembly. Epoxy has a very high dielectric value. Thus a busway can be formed in the epoxy lengthwise of the core-coil assembly, while electric isolation of the coil relative to the bus is maintained by residual epoxy remaining between the coil and busway. As a consequence, high voltage bus wire can be used, increasing the power that can be delivered to the tool. In addition the epoxy enhances heat dissipation, resistance to mechanical shock and winding protection.

The use of spacers between adjacent core-coil assemblies significantly affects the uniformity of the temperature profile developed along the casing being heated. To ameliorate this condition, the poles of adjacent core-coil assemblies are preferably alternated in a NS-SN-NS sequence. This intensifies the end effects of the magnetic flux to thereby enhance the uniformity of heating and to smooth out power density in the casing.

In another aspect, the invention includes a method for heating casing in a wellbore comprising: positioning a plurality of downhole induction heating tools along a production interval in a subterranean reservoir; each tool comprising a plurality of core-coil assemblies sealed in an electro-magnetically transparent housing; and supplying power to the core-coil assemblies to electro-magnetically heat the casing.

DESCRIPTION OF PREFERRED EMBODIMENTS

Figure 1:
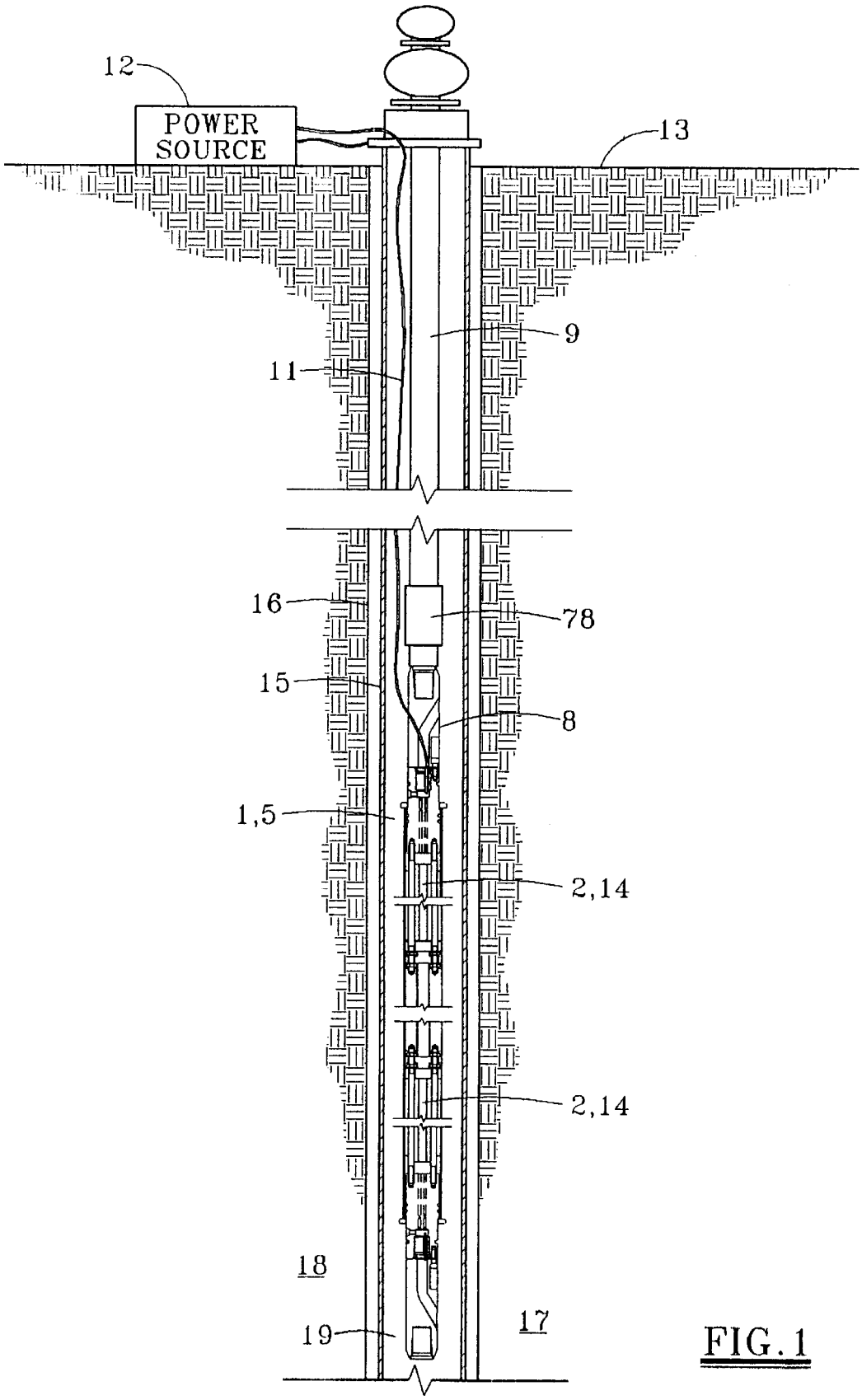
FIG. 1 is a side view showing a downhole induction-heating tool, in accordance with the invention, positioned in the wellbore of a cased vertical well.

A single tool 1, comprising a plurality of longitudinally spaced apart core-coil assemblies 2, is shown in FIG. 1, in the context of a vertical wellbore 16. A tool having a single core-coil assembly or a stack of contiguous core-coil assemblies can be used. Several tools 1 can thus be connected in series, either end to end or spaced apart by tubing, to form a long assembly for inducing the generation of heat in casing extending through a long production interval of reservoir, which would be a typical be the assembly for use in a horizontal well. The tool 1 functions to heat a segment of production casing 15 in a wellbore 16, to thereby heat the near-wellbore region 17 of a subterranean reservoir 18, as well as fluid entering the casing 15 and fluid within the bore 19 of the casing 15. A three-phase bus 11 supplies power from a source 12 at ground surface 13 to the coils 14 of the core-coil assemblies 2. A pump 78 can be used to convey the warmed oil via the production tubing 9. This pump may be powered mechanically from the surface or electrically with the same three-phase bus 11 used to power the tool. Although only a vertical well is depicted in the drawings, those skilled in the art will appreciate that the tools disclosed herein are also ideally suited for use in a highly inclined and horizontal well application.

Figure 2:
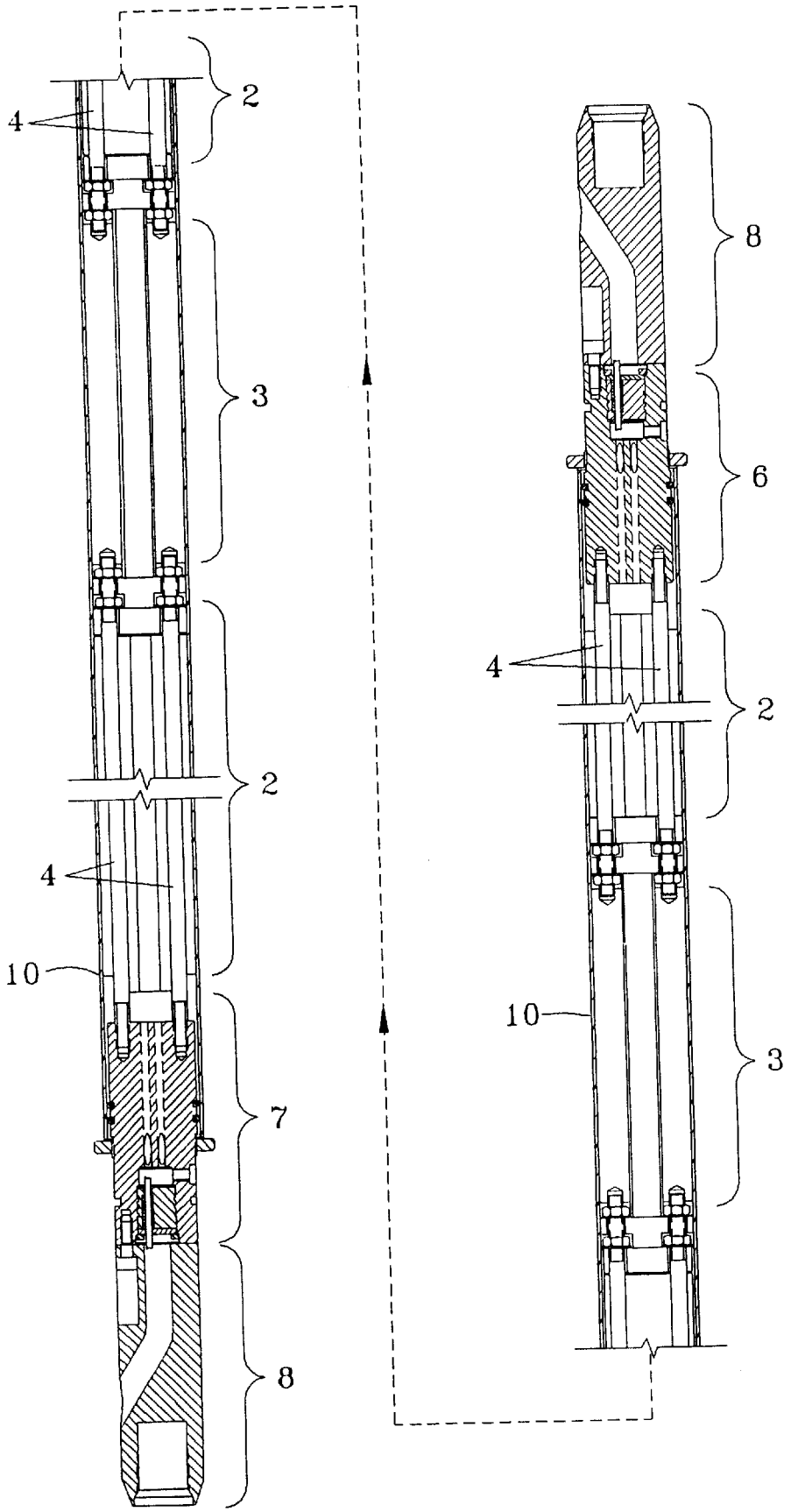
FIG. 2 is a simplified sectional side view of the tool of FIG. 1.

The specific embodiment of the downhole induction-heating tool 1 shown in FIG. 2, comprises a series of longitudinally spaced apart, axially aligned core-coil assemblies 2. Flexible, inter-coil connector assemblies 3 are positioned between the core-coil assemblies 2. Reinforcing rods 4 extend through each core-coil assembly 2. These rods 4 are rigidly connected with the flexible, inter-coil connector assemblies 3. The elongated assembly 5 of core-coil reinforcing rods 4 and flexible, inter-coil connector assembly assemblies 3, is connected at its ends with top and bottom end caps 6,7, to form an internal longitudinal reinforcement structure or 'skeleton' 20, shown in FIG. 3. The top end cap 6 is connected with an end connector 8, for connecting with the well tubing string 9. A similar end connector 8 is attached to the bottom end cap 7, if the tool 1 is to be connected by tubing with another tool. If no tool is connected below, a hole-finder or bull nose may be attached to the lower end cap 7. By comparing FIG. 2, which shows the primary components of the entire tool, to FIG. 4, which shows a detailed view of the lower head of the tool, it can be seen that the upper and lower heads of the tool are essentially identical. An outer housing 10 jackets the core-coil assemblies 2 and flexible, inter-coil connector assembly 3 and is sealed to the end caps 6,7. The housing 10 and the skeleton 20 are both elongate members, each having a common central axis which is the axis of the tool.

The tubular housing 10 also protects the tool internals as the tool is both run into or out of the casing bore 19 and when the tool is being shipped or being stored at the rig site.

Tests show that a stainless steel housing, which is only non-magnetic, experienced excessive heat losses. The power transfer efficiency was only in the range of 70 or 80%. As a result, the coil assembly overheated, causing premature tool failure. Accordingly, the amount of power that could be applied to the core coil assembly was practically limited.

According to the present invention, non-magnetic and electrically insulating material, preferably fibreglass or glass-reinforced epoxy, forms the material of the outer housing 10. A non-magnetic material is one with a relative permeability near or equal to 1. An electrically non-conductive material is one with high electrical resistivity, such that the material is classified generally as an insulator, not a semi-conductor or a metal. In a fibreglass material, both the structural fibres and the matrix material are electrical insulators. Carbon preferably should not be substituted for glass because, although carbon is stronger, it is also electrically conductive. Testing has shown that use of the material significantly reduces heat losses and thus allows high casing temperatures to be achieved, while internal tool temperatures remain relatively cool at acceptable levels. Power transfer efficiencies approximating 90% have been achieved with the non-magnetic and electrically non-conductive housing.

Bench scale testing of a tool having a fibreglass housing, mounted in a casing with water running through the annular space between the two, demonstrated that the tool coil operated cooler than the casing. In contrast, when the same tool was provided with a stainless steel housing and tested in the same way, the temperatures of the casing and core-coil assembly remained about equal.

A tube formed of non-magnetic and electrically non-conductive material, such as an unfilled thermoplastic or a filled plastic such as fibreglass, typically will not have the required structural strength in axial compression or tension, at elevated temperatures, to achieve the objectives of a tool having a metal housing. The fibreglass is typically about 70% glass fibres, with a matrix of high temperature epoxy resin. This resin may be a mixture of bis-phenol-A and phenolic novalac, cured with an aromatic amine. Despite the fact that the material is strong, the thin sectional area of the tube may not provide for enough material for structural support. Since the tool needs to be axially robust, the present invention combines the internal structural skeleton 20 with the longitudinally weak outer housing 10.

The length and diameter of the housing 10 establishes the size of the tool 1. The tool preferably may be about thirty feet in length. Tool diameter must be selected so as to balance the conflicting design requirements of (1) minimizing the pressure drop of fluids passing between the tool housing 10 and the well casing 15, which requires a large clearance, and (2) maximizing the magnetic transfer efficiency, which requires a small clearance. Typically in well casing having an inside diameter of 4 ⅞ inches, a fibreglass outer housing 10 may have an outside diameter of 4 ⅜ inches. The housing 10 may have a wall thickness of 3/16 inches.

The structure and fabrication of the tool 1 will now be described, from the top of the tool downwardly.

Figure 3:
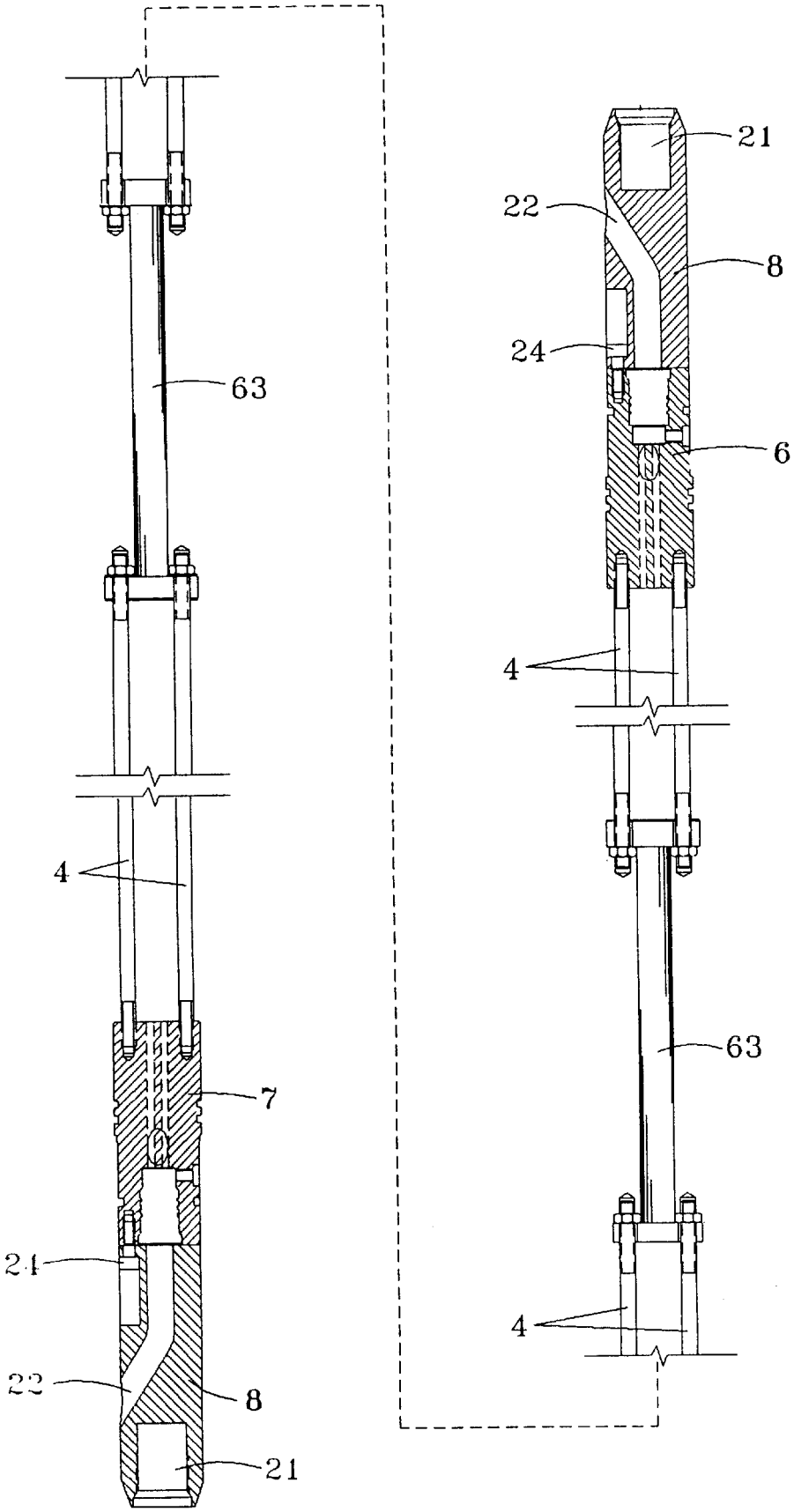
FIG. 3 shows the structural backbone of the tool.

Referring to FIGS. 1, 2 and 3, commencing at the top of the tool 1, it comprises an end cap 6 secured to an end connector 8. These members may be formed of 17-4 PH stainless steel, as are the other structural members of the skeleton 20. The end connector 8 has a threaded coupling 21 at its top end for connecting with the tubing string 9. A cable through hole 22 provides access for the three-phrase bus 11, comprising power bus wires 23, to enter the tool 1. Bolts 24 secure the end connectors 8 to the end cap 6and 7.

Figure 5:
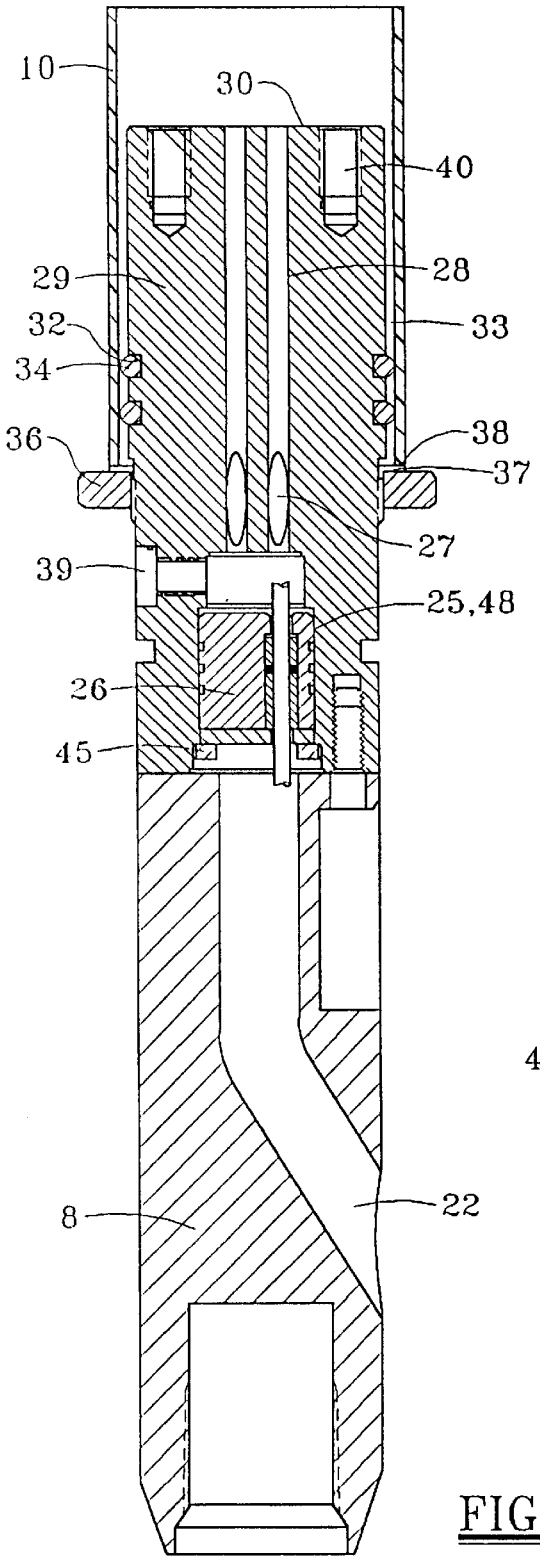
FIG. 5 is a larger scale, sectional side view of the end cap, stuffing box assembly, and composite housing, showing a bus wire extending therethrough.

Having reference to FIGS. 5, the body 29 of the end cap 6 forms an axial cavity 25 at its upper end. The cavity 25 is adapted to receive a stuffing box assembly 26, shown in FIG. 6. Angular passageways 27 connect the cavity 25 with portholes 28 extending through the cap body 29 to its lower end face 30. Circumferential O-ring grooves 32 are formed in the side surface 33 of the cap body 29. O-rings 34 are seated in the grooves 32 and function to seal against the inside surface 35 of the outer housing 10. A lock nut centralizer 36 is threaded onto the cap body side surface 33, for centralizing the upper end of the tool 1 in the casing 15. An end seal 37 is positioned between the top end 38 of the housing 10 and the centralizer 36, for protecting the end of the fibreglass housing 10 from invasion by wellbore fluid along the fibers. A threaded oil drain port 39 is formed between the stuffing box cavity 25 and the cap side surface 33. A plug (not shown) closes the port 39 when the tool 1 is filled with oil. Threaded bolt holes 40 extend into the cap body 29 from the lower end face 30, for connecting with the reinforcing rods 4 of the adjacent core-coil assembly 2.

Figure 6:
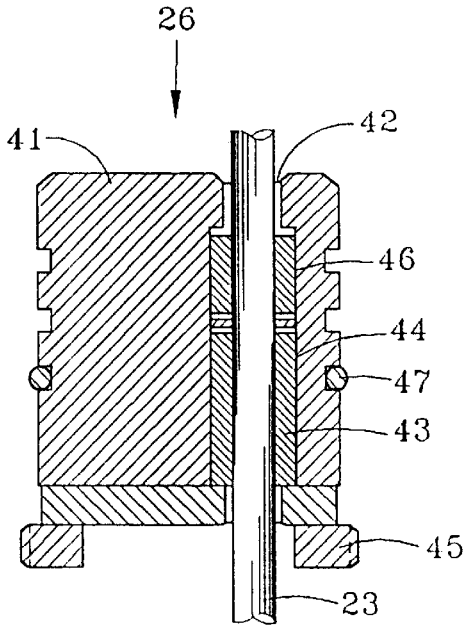
FIG. 6 is an enlarged sectional view of the stuffing box.
Figure 7:
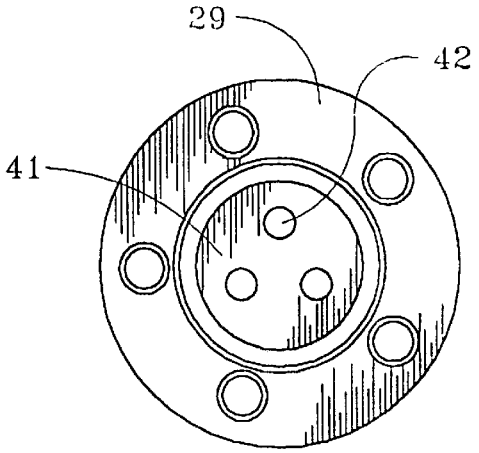
FIG. 7 shows a sectional end view of the end connector at the level of the end cap.

Having reference to FIG. 6, the stuffing box assembly 26 comprises a body 41 having three parallel bores 42 extending therethrough. One of the bus wires 23 extends through each bore 42. A seal 43 seals between the bore surface 44 and the bus wire 23. A retaining plate 45, threaded into the cavity 25, holds the body 41 in place. A retaining spring 46 compresses the seal into sealing engagement. The body 41 carries external O-rings 47 that seal against the cavity surface 48.

From the foregoing, it will be understood that the end caps 6 and 7, and end connector 8 provide for:

connecting with the tubing string 9;

introducing the three-phase power bus 11 into the tool 1, while maintaining fluid isolation of the interior of the tool relative to wellbore fluid;

provide end closure and sealing to the outer housing 10;

centralize the tool 1 at its ends;

enable filling the tool with oil; and structurally couple the load bearing skeleton 20 to the tubing string 9.

Other structures may achieve the same objectives. For example, the stuffing box assembly may be replaced with male and female, connectors of the type often used in downhole pumps and in wellhead pass-throughs.

Figure 8A:
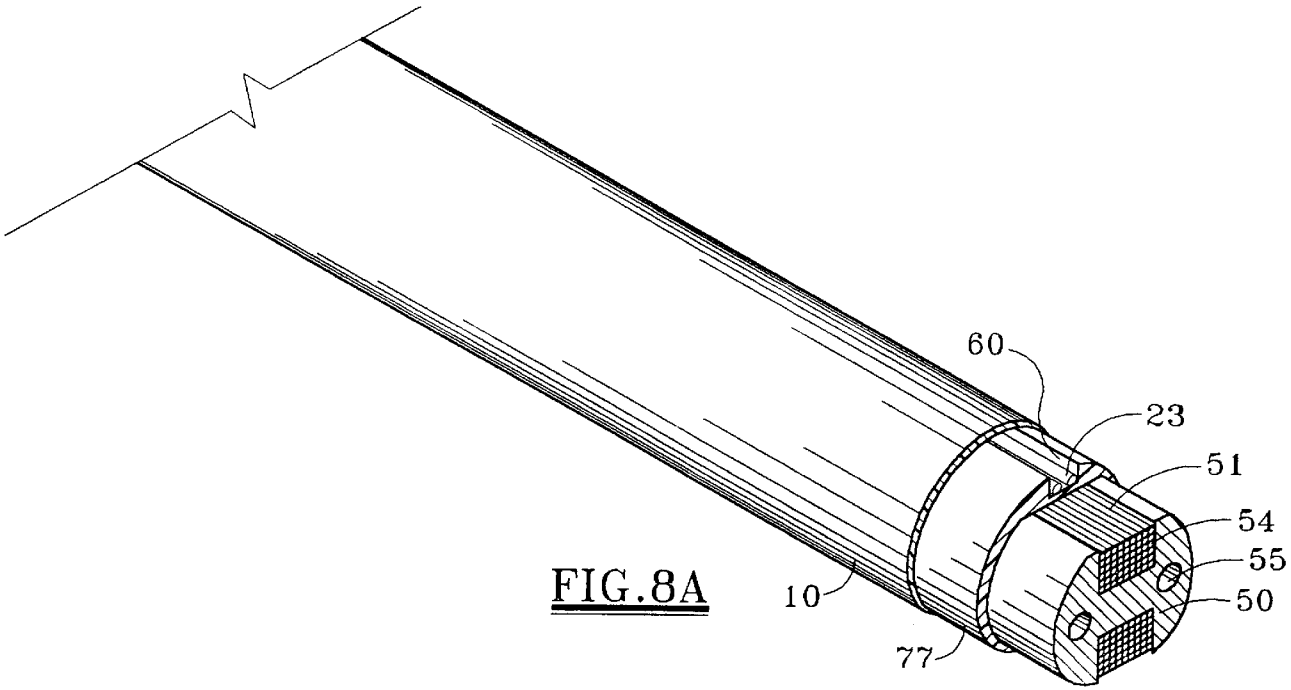
FIGS. 8A and 8B show a perspective and longitudinal sectional view of one encapsulated, core coil assembly.
Figure 8B:
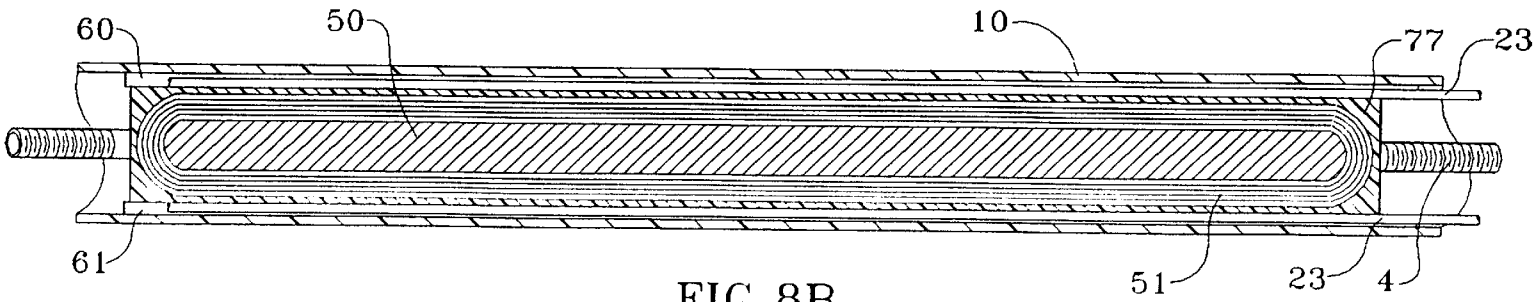
Figure 10:
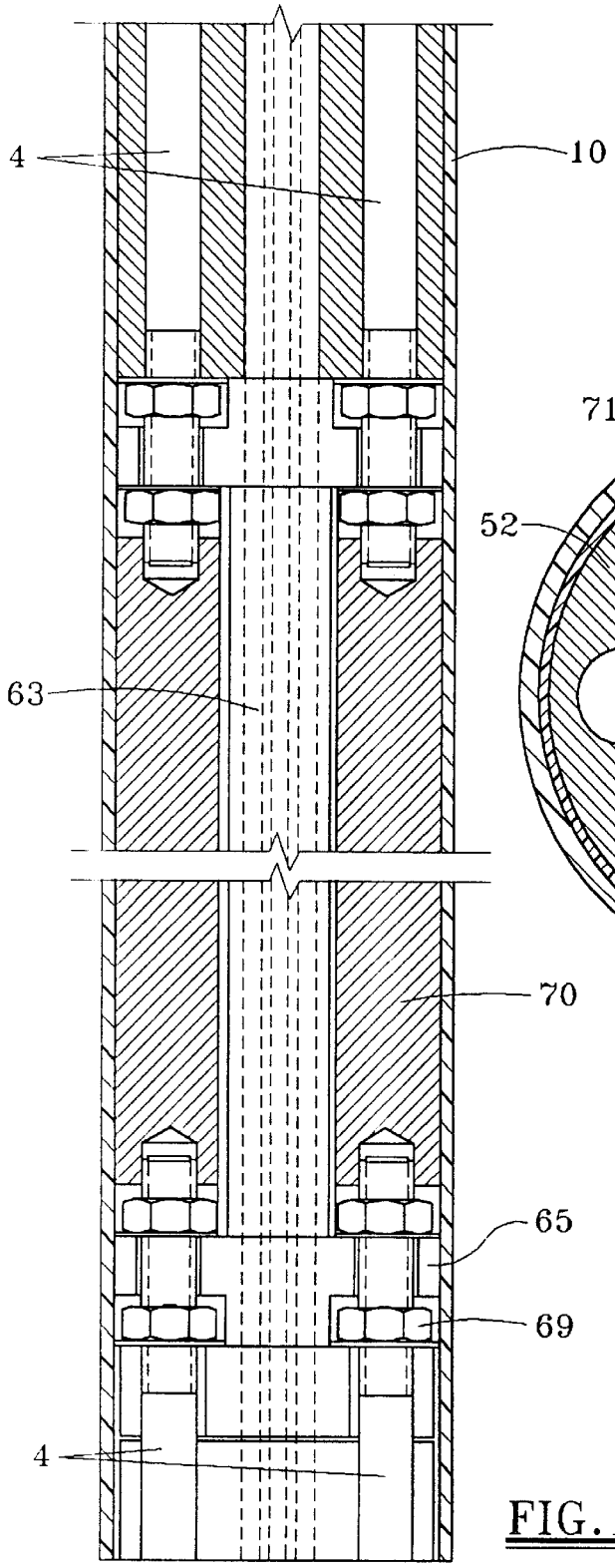
FIG. 10 is a sectional side view of an inter-coil spacer assembly positioned between and connected with two core-coil assemblies in series, the inter-coil spacer assembly comprising an inter-coil spacer and an inter-coil housing unit, all jacketed by the housing.
Figure 9:
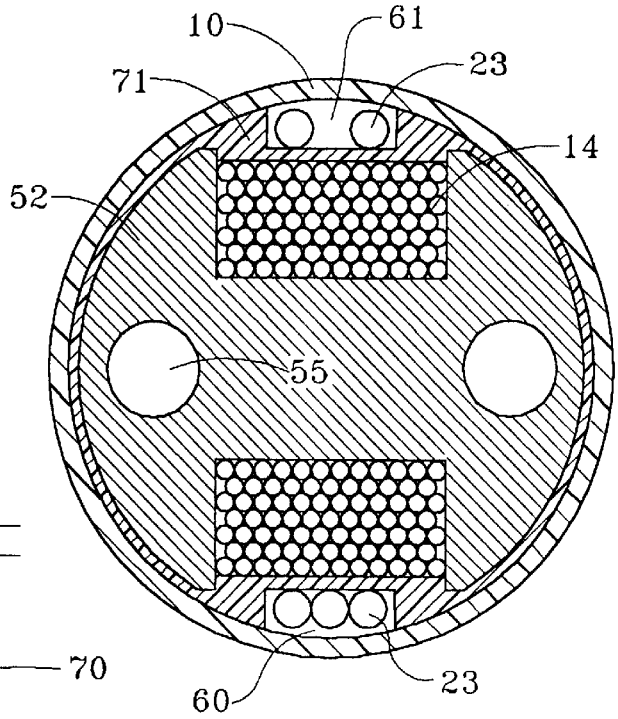
FIG. 9 shows a sectional end view of the core-coil assembly of FIG. 8, showing the bus wires in place and jacketed in the outer housing.
Figure 11:
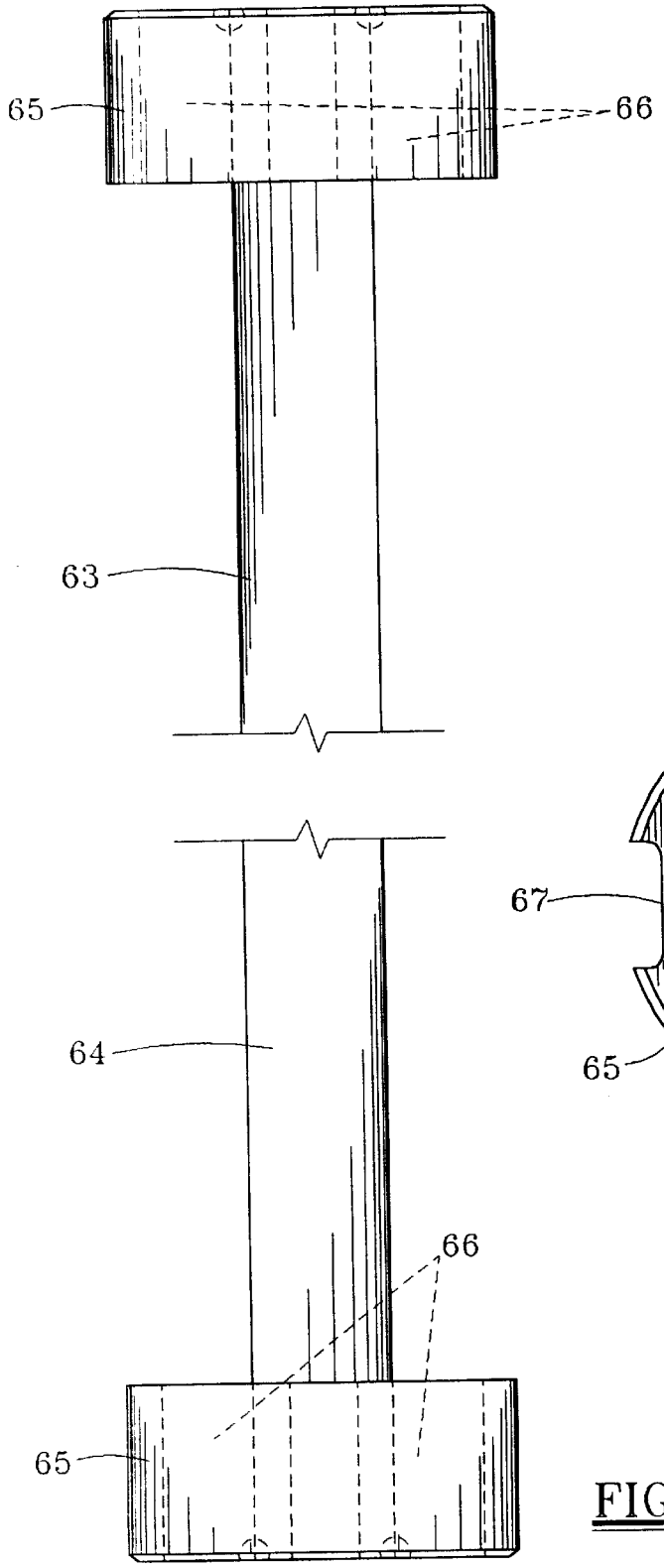
FIG. 11 and 12 show the intercoil flexible connection in side and end view.
Figure 12:
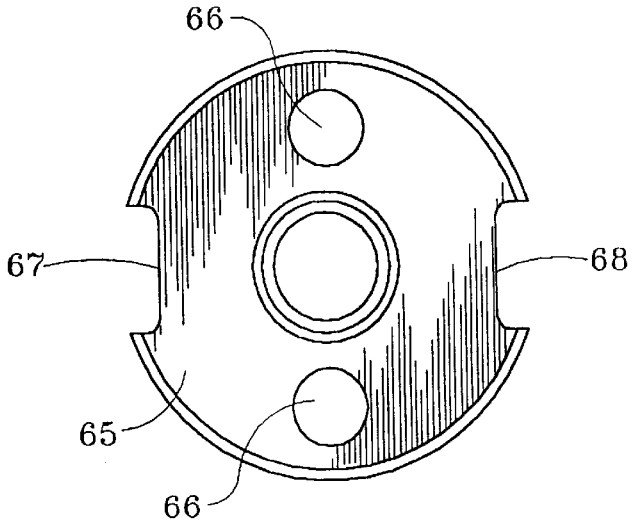

Having reference now to FIGS. 8 and 9, the core-coil assembly 2, extending downwardly from the end cap 6, comprises a magnetically permeable core 50 and conductive windings 51 wound thereon to form a coil 14.

The core 50 is formed by stacking laminations 52 of material that is highly conductive and has large magnetic permeability, such as silicon steel M-19. Otherwise stated, the core material is selected to produce a large magnetic flux. A typical core 50, 3 ¾ inches in diameter, consists of over 2000 laminations 52 stacked in an axial direction, parallel to the direction of the wellbore 16. The core 50 is later encapsulated in epoxy and subsequent inserted into the housing 10. The core stack 53 is generally cylindrical in configuration and provides channels 54, into which the windings 51 are to be wound. The core so includes longitudinal rod passageways 55 through which the reinforcing rods 4 will extend. Once the laminations 52 are stacked, formed and properly aligned, the core 50 may be dipped into varnish and baked until the varnish hardens. The dip and bake procedure bonds the laminations 52 together to form a cohesive unit. The dipped and baked core 50 has sufficient mechanical strength to ensure that the alignment of laminations 52 is maintained and that the laminations hold together during subsequent fabrication steps.

The windings 51 are formed of standard copper transformer wire. They are wound, using a winding machine, into the channels 54. Typically, 220 turns of 12-gauge wire are wound around the core 50 to produce a core-coil 56. This unit may be milled to align its end faces to within less than five thousandths of an inch tolerance.

The core 50 and windings 51 together, function to produce an electromagnetic field in the casing 15. The electromagnetic field transfer is similar in concept to that of a transformer. The current flowing in the windings 51 produces a magnetic field in the laminated core 50. The core 50 produces a large magnetic flux. The magnetic field generated in the core 50 induces a magnetic field in the casing 15, which in turn causes eddy currents and hysteresis in the casing. Thus, the magnetic field generated in the casing is similar to the magnetic field induced in the secondary windings of a transformer and the casing 15 represents the short circuited, single turn secondary of that transformer.

Encapsulation of the core 50 with windings 51 is described below. The epoxy used may be selected with the following characteristics in mind:

- it should be capable of providing protection to the windings 51 from water, wellbore chemicals and hydrocarbons;
- it should provide a high value of thermal conductivity;
- it should be capable of some elongation to absorb shock and protect the core 50 with windings 51;
- it should have high dielectric breakdown characteristics to protect the windings 51 from large voltage gradients and spikes; and
- it should be amenable to machining. Since the encapsulated core-coil assemblies 2 have to be fitted into the housing 10 and between other components of the tool, it is desirable that dimensions be controlled to close tolerances. Machining forms the power bus way 60, and 61.

The core 50 with windings 51 may be placed into a vacuum mold (not shown), with the wire lead-outs from the windings extending out of the mold and the reinforcing rod passageways 55 temporarily plugged, so as not to fill them. A selected epoxy, such as Ripley Resin #468-2, may be poured in and the mold contents baked to harden and cure the epoxy. Other epoxies could serve equally well, provided they had the characteristics or high temperature capability, good adhesion and enough flexibility to avoid fracture during cooling after the cure process or when the tool is stressed while being flexed, either during installation or transportation. After cooling, the encapsulated core-coil assembly 2 is machined to the desired dimensions and the power bus-way 60, 61 are milled out, to complete fabrication. In milling the busways 60, 61, an acceptable minimum epoxy coating over the windings 51 may be about 2.5 mm.

Figure 4:
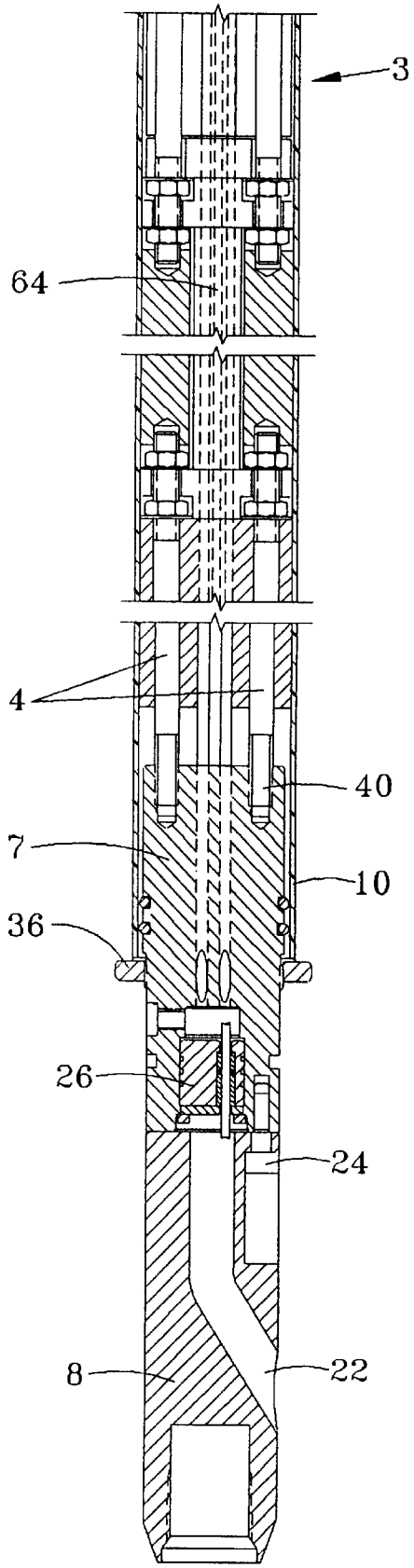
FIG. 4 is a sectional side view showing the bottom end connector and bottom end cap connected with the composite housing.

Returning now to the description of the tool 1 and referring to FIGS. 4,5 and 8, steel reinforcing rods 4 extend through the core rod passageways 55. The top ends of the rods 4 are threaded into the boltholes 40, thereby connecting the end cap, 6 or 7 and the reinforcing rods 4 of the top core-coil assembly 2. The power bus wires 23 extend from the end cap 6 along the busway 60. The reinforcing rods 4 are connected with the top inter-coil spacer assembly 3.

Having reference to FIGS. 10 through 14, a flexible, inter-coil connector assembly 3, extends downwardly from the top core-coil assembly 2. The assembly includes a flexible connector element 63. The flexible element 63 includes a central bending moment bar 64 having an axis aligned with the longitudinal tool axis and two load-coupling end members 65 connected thereto. Each load-coupling end member 65 is formed to provide openings 66 for receiving the reinforcing rods 4 of the top core-coil assembly 2. The end member 65 further forms power bus breakouts 67, 68, through which the power bus wires 23 extend.

The bar 64 and end members 65 may be formed of steel. The steel diameter and length of the bar 64 are preferably selected to provide a desired amount of lateral flexing. i.e. Flexing with a plane intersecting the longitudinal tool axis. The bar 64 may achieve a minimum bending radius of about 20 degrees per hundred feet. The breakouts 67, 68 contribute to providing continuous busways from one end of the tool 1 to the other. The flexible connector element 63 contributes to providing part of the structural skeleton 20 extending from the top cap 6 to the bottom cap 7.

The bending moment bar 64 and load coupling end members 65 are assembled with an interference fit. This connection may be strengthened with a weld (not shown) on the outside end face of each end member 65. The welding procedure incorporates preheating and postheating to minimize metal embrittlement. A casting process could form the same assembly.

As shown in FIG. 6, the reinforcing rods 4 of adjacent core-coil assemblies 2 are connected to the intervening flexible connector element 63 and tied together by nuts 69. The nuts 69 enable pre-tensioning of the reinforcement rods 4 to compensate for thermal expansion of the core-coil assembly 2.

Figure 13:
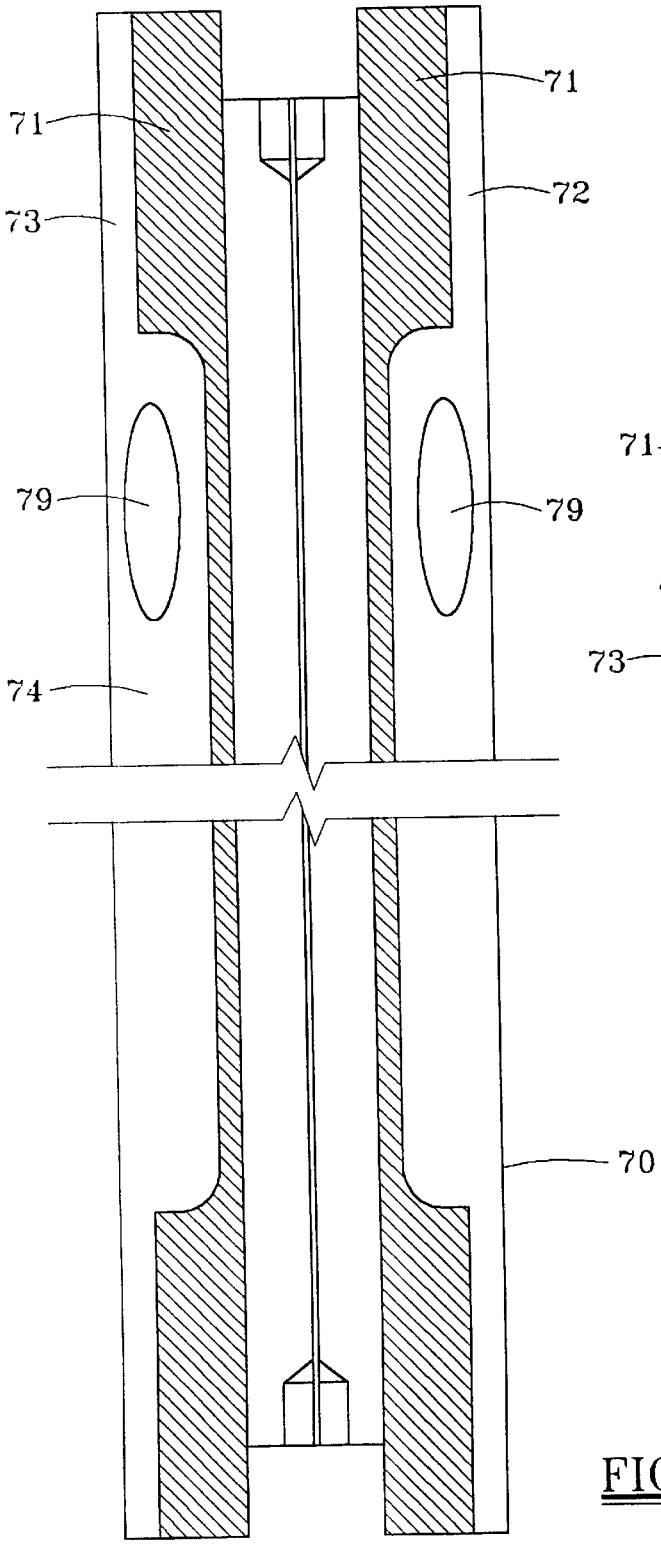
FIGS. 13 and 14 show the intercoil spacer in side and end view.
Figure 14:
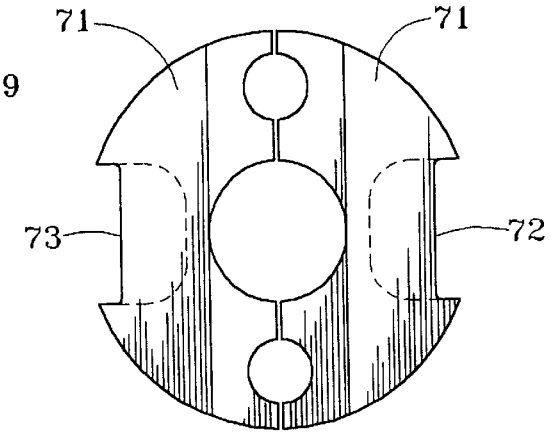

The inter-coil spacer assembly further comprises an inter-coil housing unit 70, shown in FIGS. 13 and 14, may be formed of aluminium and split longitudinally into two halves 71. The halves 71 are each formed to fit around the flexible connector element 63 and the ends of the reinforcing rods 4 and provide spacer power wire bus-way 72, 73. The busways 72, 73 are deepened intermediate their ends to form splicing pockets 74.

The inter-coil housing unit 70 is provided to reduce void space in the tool 1. This void space will otherwise be occupied by transformer oil, which can expand when heated.

The sequence of identical core-coil assemblies 2 and identical flexible, inter-coil connector assemblies 3 is repeated down the tool 1 to the bottom end cap 6. However, the north and south poles of the cores 50 of adjacent core-coil assemblies 2 are alternated 180 degrees out of phase. This is done to enhance the end effect phenomenon of each core-coil and thereby cause more uniform heating in the adjacent casing 15.

To summarize, the tool 1 comprises:

- a plurality of identical core-coil assemblies 2, the upper and lower end of the assemblies being linked together by flexible, inter-coil connector assembly 3;
- the core-coil assemblies being encapsulated in epoxy to provide electrical isolation for the windings 51;
- with busways 60, 61 extending longitudinally of the tool for conveying power to each core-coil assembly;
- with a structural skeleton 20, comprised of the end caps 6,7, reinforcing rods 4 and spacers 63, providing axial load strength and yet having limited flexibility; and
- with an non-magnetic and electrically insulating external housing 10, sealed to the end caps, enclosing the core-coil assemblies.

The tool is modular, in that several can be strung together in a string. It is generic in that the same tool can be used in vertical, inclined or horizontal wells. The tool also is capable of high voltage, and high power transfer efficiency in operation.

Figure 15:
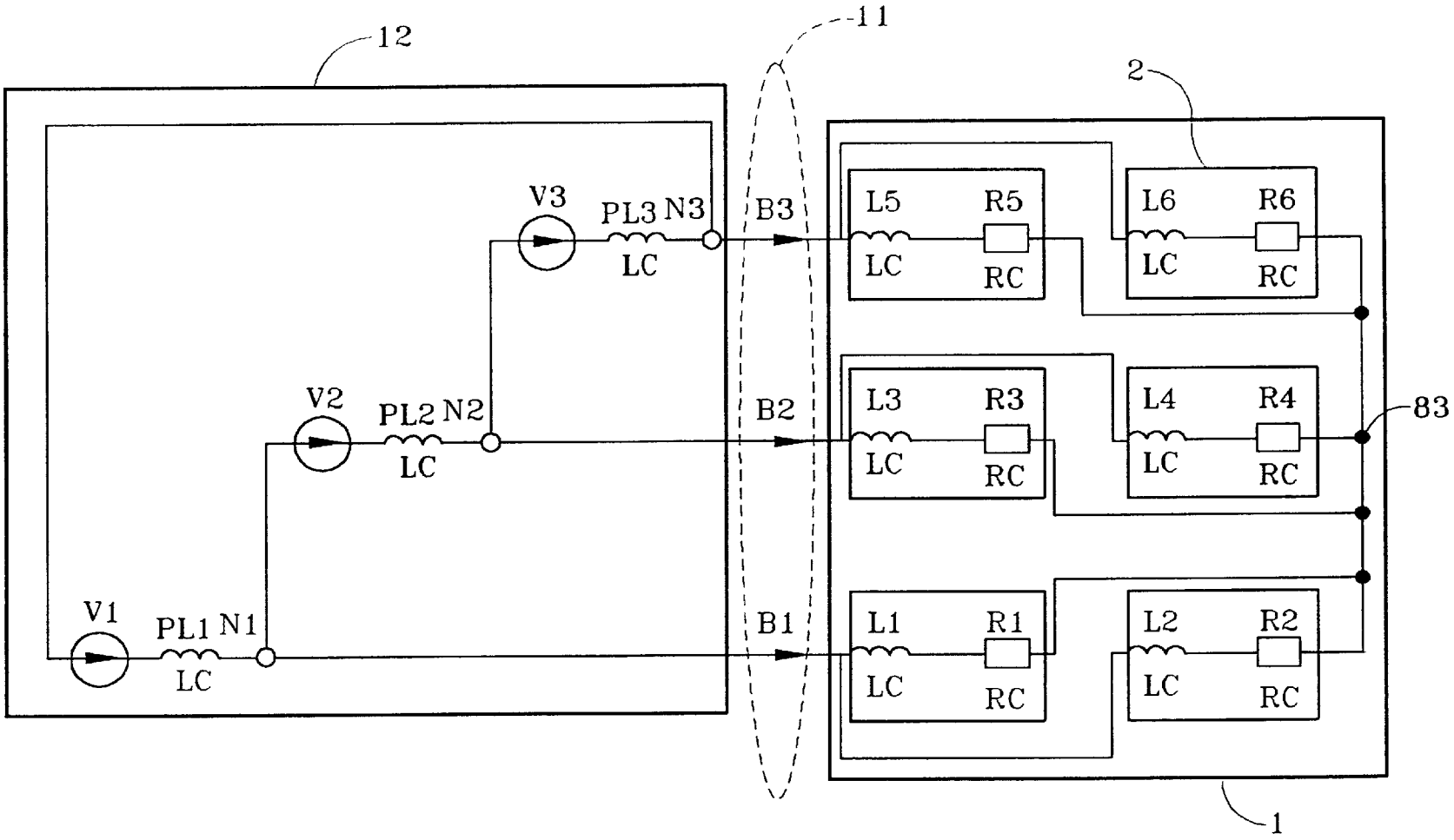
FIG. 15 is a circuit diagram of the tool.

Having reference now to FIG. 15, the electrical system of an exemplary tool 1, having six core-coil assemblies 2, is shown. More particularly, the core-coil assemblies are connected in a parallel star configuration to the three-phase power bus 11. In FIG. 15, the three phase power source is indicated by the voltage source $V_1$, $V_2$, and $V_3$. Associated with each phase of the power source is an internal inductance, indicated by PL1, P12, and P13, which have a value of between 1.0 to 4.0 mH. The output terminals of the three-phase power source are indicated by $N_1$, $N_2$, and $N_3$. The relationship between the voltages at the terminals is given by the following:

$$V1=A1*\sin(wt+2Pi/3*f1)$$

$$V2=A2*\sin(wt+2Pi/3*f2)$$

$$V3=A3*\sin(wt+2Pi/3*f3)$$

The phase relation factors are $f_1$,$f_2$, and $f_3$ and ideally are equal to 0, 1, and 2. If this holds true, then the sum of the instantaneous current flowing from the terminals is exactly equal to zero at any moment in time. Under these conditions, the electrical losses in the cable system between the tool and the three-phase power source are minimal.

Current flows from the output terminals of the three-phase power source 12, located on the surface, via a three-phase bus cable 11. The branches, B1, B2, and B3 indicate these currents. Cable impedance losses are assumed insignificant, to a first approximation.

The tool preferably comprises three or six core coil assemblies in each tool. An inductance Lc and a total resistance Rc electrically represent each core coil assembly, where the subscript c represents core-coil. The respective value of each of the core-coil assemblies is further noted by the number subscript. For all practical purposes, the inductance and resistance of each core-coil are the same. A typical value would be 10+j30 ohms.

The inductance of the casing is small. Therefore, the inductance of the equivalent circuit essentially represents the inductance of the core-coil assembly. To increase the heating capacity of the tool, it is necessary to increase the reflected resistance. This can be achieved using more turns and or reducing the gap between the tool and the casing.

In FIG. 15, the core-coil assemblies are connected in parallel. For the values of inductance and total resistance, this is the optimum configuration. For other values of inductance and total resistance, it may be necessary to connect the core coil assemblies in series to achieve optimum results, ie., allowing operation of the three-phase bus 11 at its maximum voltage and current ratings.

The core-assemblies are connected in a star, or Y circuit configuration. This type of connection simplifies transmission of pressure and temperature data, should these sensors be incorporated into the tool.

Lead wires from the core-coil assemblies 2 are directed along the busway, 60 with the three-phase power bus. The electrical connection between each core-coil assembly 2 to the three-phase power bus 11 and to each other at the star or Y point 83 is located in the splicing pockets 74.

A downhole induction heating tool connected to a three-phase power delivery system was disclosed in detail above. Those skilled in the art will recognize that a single phase, dual phase, or multi-phase electrical power source may be connected to the downhole induction heating tool without deviating from the invention.

Referring again to FIG. 13, it is contemplated that sensors 79, such as temperature and pressure sensors, can be located in the splicing pockets 74 and connected with the three-phase power bus 11.

The tool 1 is filled with oil, to provide pressure compensation within the tool. The oil is introduced through oil drain port 39 under vacuum conditions, to minimize the presence of gas bubbles in the oil.

The preceding has described a method of fabricating a downhole induction-heating tool 1 and installing it on production tubing 9, for the purposes of generating heat in the well bore casing.

The tool described has two reinforcing rods 4 for the core coil assembly 2. The number of reinforcing rods could be reduced to one or increased to several without effecting the tool's general operation. Locknut centralizers 36 centralize the tool described. Similarly, the tool could be centralized by strips or bumps applied to the housing 10. The tool described conveys the three-phase bus 11 into the tool via a stuffing box assembly 26. Similarly, the bus could be brought into the tool via a connector assembly. The tool described has a thin-walled, non-magnetic and electrically non-conductive housing 10, which is not structural. Alternatively, it would be possible to construct a tool with a thick-walled, non-magnetic and electrically non-conductive housing, in which the housing could serve as the axial structural support for the tool. In another feasible configuration, it would be possible to fabricate a tool that did not use a housing. Although it may not be as rugged, it could be functional.

Production tubing 11 provides the mechanism for installing the tool into the wellbore and positioning it along a production interval and below a pump also supported in the well from the production tubing. This same tubing conveys fluids produced from the reservoir 18. Another approach that could be employed in vertical and deviated wells would be to install the tool with a three-phase bus with sufficient tensile strength to support the tool. This would be analogous to wireline tool conveyance and operation. Reservoir fluids could then be produced via the casing 15 directly.

Various modifications to the heating tool and to the methods described herein should become apparent from the above description of preferred embodiments. Although the invention has thus been described in detail for these embodiments, it should be understood that this explanation is for illustration, and that the invention is not limited to these embodiments. Various types of tools and operation techniques will thus be apparent to those skilled in the art in view of this disclosure. Modifications are thus contemplated and may be made without departing from the spirit of the invention, which is defined by the claims.

What is claimed is:

1. A downhole induction heating tool for use in a well extending downward from the surface to one or more production intervals to heat well casing and thereby lower the viscosity of recovered fluid, said tool comprising:

an end connector for engaging a lower end of one of a moveable tool supporting string and a wireline for positioning the downhole induction heating tool along a selected production interval of the well;

a core-coil assembly including a magnetically permeable core and a conductive wire coil associated therewith, the conductive wire coil encircling the core to form multiple coil windings; and an outer tubular housing jacketing the core-coil assembly, the housing being formed of non-magnetic and electrically insulating material.

2. The tool as defined in claim 1, further comprising:

one or more structural members for reinforcing the tool in axial tension and compression, said structural members extending longitudinally and internally through the housing.

3. The tool as defined in claim 1, further comprising:

an epoxy encapsulating the core-coil assembly within the housing.

4. The tool as defined in claim 3, wherein the epoxy forms a busway extending longitudinally of the core-coil assembly, the busway being spaced from the conductive wire coil by epoxy for electrically isolating the coil.

5. The tool as defined in claim 1, wherein the housing is formed from a fibreglass material.

6. A downhole induction heating tool for use in a well extending downward from the surface to one or more production intervals to heat well casing and thereby lower the viscosity of recovered fluid for enhanced recovery, said tool comprising:

a magnetically permeable core;

a conductive wire coil wound around the core; and one or more structural members extending longitudinally and internally through the core and forming a skeleton for providing reinforcement in axial compression and tension.

7. The tool as defined in claim 6, wherein the one or more structural members comprises:

one or more rods each extending through the core; and one or more connectors each positioned longitudinally from the one or more rods, said connectors being flexible in a lateral direction and connected with the one or more rods.

8. The tool as defined in claim 6, further comprising:

an outer tubular housing; and top and bottom cap members closing the ends of the housing, said cap members being fixed to said one or more structural members.

9. The tool as defined in claim 8, further comprising:

an upper and lower seal each for sealing the housing to respective top and bottom cap members.

10. The tool as defined in claim 6, further comprising:

each core and coil forming a core-coil assembly; and an epoxy encapsulating each core-coil assembly.

11. The tool as defined in claim 10, wherein:

each of said plurality of core-coil assembly has north and south poles; and the poles of the core-coil assemblies are arranged along the tool in an alternating N-S, S-N, N-S sequence.

12. The tool as defined in claim 6, further comprising:

an outer tubular housing;

the one or more structural members including a plurality of elongate rods each within the housing and longitudinally adjacent to a respective core; and a plurality of flexible connectors each within the housing and positioned longitudinally between respective cores and connected to said elongate rods.

13. A downhole induction heating tool for use in a well extending downward from the surface to one or more production intervals to heat well casing and thereby lower the viscosity of recovered fluid, said tool comprising:

a plurality of longitudinally aligned core-coil assemblies, each including a magnetically permeable core and a conductive wire coil associated therewith;

an outer tubular housing jacketing each of the core-coil assemblies, the housing being formed of non-magnetic and electrically insulating material; and a skeleton of structural members within the housing and extending longitudinally and internally through the core-coil assemblies for providing reinforcement in axial compression and tension.

14. The tool as defined in claim 13, further comprising:

top and bottom cap members closing ends of the housing; and said cap members forming part of the skeleton.

15. The tool as defined in claim 14, wherein the skeleton further comprises:

a plurality of rods each extending through a respective core-coil assembly; and a plurality of inter-coil connectors each positioned between a pair of core-coil assemblies, said connectors being flexible in a lateral direction and connected with the rods of adjacent core-coil assemblies.

16. The tool as defined in claim 14, further comprising:

an upper and lower seal each for sealing the housing to respective top and bottom cap members.

17. The tool as defined in claim 14, further comprising:

an epoxy encapsulating each core-coil assembly within the housing.

18. The tool as defined in claim 17, further comprising:

said epoxy and skeleton forming busways, extending longitudinally within the housing, for receiving power bus wires; and said cap members include passageways for introducing power wires into the busways.

19. The tool as defined in claim 14 wherein:

each of said plurality of core-coil assembly has north and south poles; and the poles of the core-coil assemblies are arranged along the tool in an alternating N-S, S-N, N-S sequence.

20. The tool as defined in claim 14, further comprising:

an epoxy encapsulating each core-coil assembly;

said epoxy and skeleton forming busways, extending longitudinally within the housing, for receiving power bus wires;

said cap members including passageways for introducing power bus wires into the tool;

each core-coil assembly has north and south poles; and the core-coil assemblies are arranged in an alternating N-S, S-N, N-S sequence.

21. A method for heating casing in a wellborn extending downward from the surface to one or more production intervals to enhance recovery of fluids, comprising:

providing a tool including a magnetically permeable core, a conductive wire coil wound around the core, and an outer tubular housing formed from an non-magnetic and electrically insulating material jacketing the core and the coil;

positioning the tool in the wellbore along a production interval of a subterranean reservoir; and supplying electrical power to the coil to electromagnetically heat the casing.

22. The method as defined in claim 21, further comprising:

providing one or more structural members within the housing for reinforcing the tool in axial tension and compression.

23. The method as defined in claim 21, further comprising:

the core and coil forming a core-coil assembly within the housing; and encapsulating the core-coil assembly in an epoxy.

24. The method as defined in claim 21, further comprising:

providing one or more rods each extending through the core; and providing one or more connectors each positioned longitudinally from the one or more rods, each connector being flexible in a laterally direction and connected to the one or more rods.

25. The method as defined in claim 21, further comprising:

sealing an interior of the housing from an exterior of the housing.

26. The method as defined in claim 21, wherein the tool includes a plurality of longitudinal cores and a corresponding plurality of coils to form a plurality of a core-coil assemblies each having north and south poles; and arranging the poles in alternating N-S, S-N, N-S sequence.

27. The method as defined in claim 21, further comprising:

forming a busway extending longitudinally of the coil, the busway being spaced from the coil by epoxy for electrically isolating the coil.

* * * * *